US011359265B2

(12) United States Patent
Zhang et al.

(10) Patent No.: US 11,359,265 B2
(45) Date of Patent: Jun. 14, 2022

(54) 1 GPA HIGH-STRENGTH HIGH-MODULUS ALUMINUM-BASED LIGHT MEDIUM-ENTROPY ALLOY AND PREPARATION METHOD THEREOF

(71) Applicants: University of Science & Technology Beijing, Beijing (CN); Dongguan Yongtao New Material Technology Co., Ltd., Dongguan (CN)

(72) Inventors: Yong Zhang, Beijing (CN); Ruixuan Li, Beijing (CN); Tao Zhang, Beijing (CN); Yangde Li, Beijing (CN)

(73) Assignee: University of Science & Technology Beijing, Dongguan (CN)

( * ) Notice: Subject to any disclaimer, the term of this patent is extended or adjusted under 35 U.S.C. 154(b) by 102 days.

(21) Appl. No.: 16/656,843

(22) Filed: Oct. 18, 2019

(65) Prior Publication Data

US 2020/0123635 A1 Apr. 23, 2020

(30) Foreign Application Priority Data

Oct. 18, 2018 (CN) ..... 201811216996.4

(51) Int. Cl.

| | |
|---|---|
| ***C22C 21/10*** | (2006.01) |
| ***C22C 1/02*** | (2006.01) |
| ***C22C 1/03*** | (2006.01) |

(52) U.S. Cl.

CPC ..... *C22C 21/10* (2013.01); *C22C 1/026* (2013.01); *C22C 1/03* (2013.01)

(58) Field of Classification Search

None

See application file for complete search history.

(56) References Cited

U.S. PATENT DOCUMENTS

2018/0119255 A1* 5/2018 Luo ..... C22C 30/00

FOREIGN PATENT DOCUMENTS

CN 103131992 B * 5/2015

OTHER PUBLICATIONS

English language machine translation of CN-103131992-B to Ni Bin et al. Generated Aug. 27, 2021. (Year: 2021).*

* cited by examiner

*Primary Examiner* — Brian D Walck

(74) *Attorney, Agent, or Firm* — Blank Rome LLP

(57) ABSTRACT

A 1 GPa high-strength high-modulus aluminum-based light medium-entropy alloy and a preparation method thereof. An atomic expression of the designed medium-entropy alloy is $Al_xLi_yMg_zZn_uCu_v$, subscripts representing the molar percentage of each corresponding alloy element, where x+y+z+u+v=100, x is 79.5-80.5, y is 1.5-2.5, z is 1.5-2.5, u is 13.5-14.5, and v is 1.5-2.5. The phase structure of the involved alloy is mainly based on a face-centered cubic (FCC) solid solution. The present invention obtains high performance aluminum alloy ingots through vacuum induction smelting and direct casting, and features low energy consumption, decreased cost, and simple operation in the preparation process, which cater to the high requirements on cost, strength and plasticity of light alloys applied in the high-end manufacturing industries such as aerospace and automobile electronics nowadays.

3 Claims, 3 Drawing Sheets

1 GPA HIGH-STRENGTH HIGH-MODULUS ALUMINUM-BASED LIGHT MEDIUM-ENTROPY ALLOY AND PREPARATION METHOD THEREOF

RELATED APPLICATION

This application claims benefit of priority of China Patent Application No. 201811216996.4, filed Oct. 18, 2018, entitled: 1 GPA HIGH-STRENGTH ALUMINUM-BASED LIGHT MEDIUM-ENTROPY ALLOY AND PREPARATION METHOD THEREOF. The above-identified, related application is incorporated herein by reference in its entirety.

FIELD OF USE

The present invention belongs to the field of metal material preparation, and specifically relates to a high-strength high-modulus aluminum-based light medium-entropy alloy and a preparation method thereof.

BACKGROUND OF THE INVENTION

The application of light materials is one of main measures for solving the three problems such as energy, environment and safety nowadays, and is an important way to realize light weight. Aluminum alloy is a traditional light structure material, has a series of advantages, such as small density, high specific strength, high corrosion resistance, high formability and low cost, and simultaneously becomes one of research hotspots of materials used in the fields such as automobiles, aviation, aerospace and weaponry by using good formability and high regeneration of the material. Particularly, high-strength aluminum alloy meets the requirement of light weight, and also meets the performances, such as certain tensile strength, yield strength, elongation and shock resistance, of components required in the aspect of work environment, so that extensive attention and rapid development are obtained.

Recent studies have shown that a medium-entropy or high-entropy alloy can be obtained by improving the total entropy value of an alloy system. Some special performances will be obtained, and a series of performances, such as strength, hardness, abrasion resistance, corrosion resistance, high temperature resistant oxidation, high temperature resistant softening, low temperature toughness and radiation resistance, of the novel alloy break through the performance limit of traditional alloys respectively. Simultaneously, after the entropy value of the alloy system is improved, the composition of the alloy system moves to the middle part of a multi-component phase diagram from the edge of the phase diagram, but these positions are still located in a dead zone in the exploration aspect of novel materials. At present, a high-entropy alloy system which has been widely researched mainly consists of transition metal elements, such as Co, Cr, Fe, Ni, Cu, Mn and Ti, with 3d subshell electrons outside atomic nucleuses. However, the addition of a large number of transition metal elements also brings about some problems for the application of the high-entropy alloy in the fields of aerospace and the like. For example, (1) the density is large; the transition metal elements always have larger density, and this will result in larger density of a multi-component high-entropy alloy; (2) the cost is high; obviously, the prices of raw materials of existing high-entropy alloy components are often high, and in addition, these components have higher atomic percentages in the high-entropy alloy, so that the manufacturing cost of the alloy is greatly improved; and (3) the energy consumption is high, traditional high-entropy alloy components are often higher in melting points, and this will result in the improvement of energy consumption of alloy smelting.

In the present invention, a novel low-cost light high-strength aluminum-based medium-entropy alloy is prepared by using a vacuum induction melting and casting method in order to solve the above problems.

SUMMARY OF THE INVENTION

In view of the current situation, a first technical problem to be solved by the present invention is to provide a high-strength high-modulus aluminum-based light medium-entropy alloy, the compressive strength of the alloy exceeds 1 GPa, the fracture plasticity reaches 22%, the modulus of elasticity is 83 GPa, and the density is about 2.9 g/cm$^3$.

A second technical problem to be solved by the present invention is to provide a preparation method of the high-strength high-modulus aluminum-based light medium-entropy alloy.

The present invention provides the 1 GPa high-strength high-modulus aluminum-based light medium-entropy alloy, where the molecular formula of the alloy is $Al_xLi_yMg_zZn_uCu_v$, subscripts representing the atomic molar percentage of each corresponding alloy element, and the error of each composition proportion is within the range of −0.2% to +0.2%; where Al 79.5%-80.5%

Li 1.5%-2.5%

Mg 1.5%-2.5%

Zn 13.5%-14.5%

Cu 1.5%-2.5%.

The present invention provides a preparation method of the 1 GPa high-strength high-modulus aluminum-based light medium-entropy alloy, where the preparation process includes the following steps:

step 1, proportioning Al, Zn, Cu and Mg-20 wt % Li binary master alloy in alloy ingredients according to the atomic molar percentages, where the error of each composition proportion is within the range of −0.2% to +0.2%;

removing oxide layers on the surface of each raw material by using a grinding machine before proportioning, and then weighing the raw materials by using an electronic balance, where the purity of each raw material is greater than 99.9%;

step 2, putting the proportioned raw materials in a graphite crucible sequentially according to the sequence of melting points from high to low, putting an element with the highest melting point at the lowest position, and putting an element with the lowest melting point at the highest position;

step 3, putting the graphite crucible loaded with the alloy materials in a spiral induction coil, vacuumizing to 20 Pa and below by using a mechanical pump, and then introducing argon to 0.3 MPa;

step 4, starting a high-frequency induction device, gradually increasing induction heating current when the current is within the range of 100 A to 200 A, and after an alloy ingot is molten completely, maintaining the molten condition of the alloy and preserving the temperature for 13 to 17 min so that each alloy element is diffused uniformly; and step 5, turning off an induction power supply, casting an alloy melt in a stainless steel mold in a diameter of 75 mm so as to obtain an alloy ingot.

Furthermore, the temperature when the alloy is molten in step 4 is controlled between 700° C. to 1000° C.

The method of the present invention obtains alloy cast ingots through vacuum induction smelting and direct casting, and features low energy consumption, decreased cost, and simple operation in the preparation process, making possible the preparation of the medium block medium-entropy alloy. At present, aluminum alloy is widely applied to the high-end manufacturing industries such as aerospace and automobile electronics, so that people put forwards higher requirements on cost, strength and plasticity of the aluminum alloy. The aluminum-based light medium-entropy alloy prepared in the present invention has high strength, high modulus and good comprehensive performance, and enjoys a wide application prospect.

DETAILED DESCRIPTION OF THE EMBODIMENTS

Embodiment 1

Figure 1:
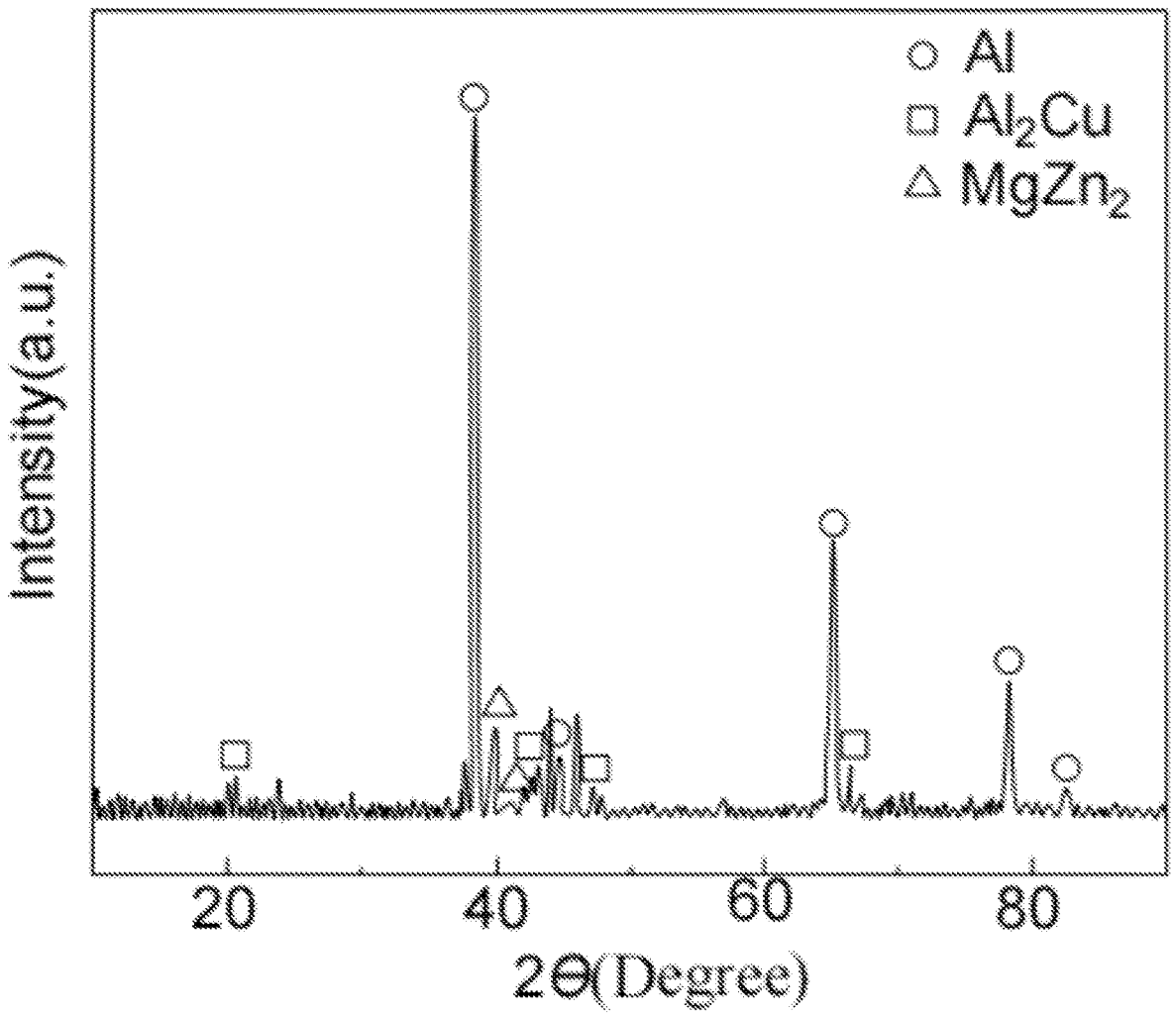
FIG. 1 is an X-ray diffraction (XRD) map of a high-strength high-modulus aluminum-based light medium-entropy alloy $Al_xLi_yMg_zZn_uCu_v$ in an embodiment of the present invention.
Figure 2:
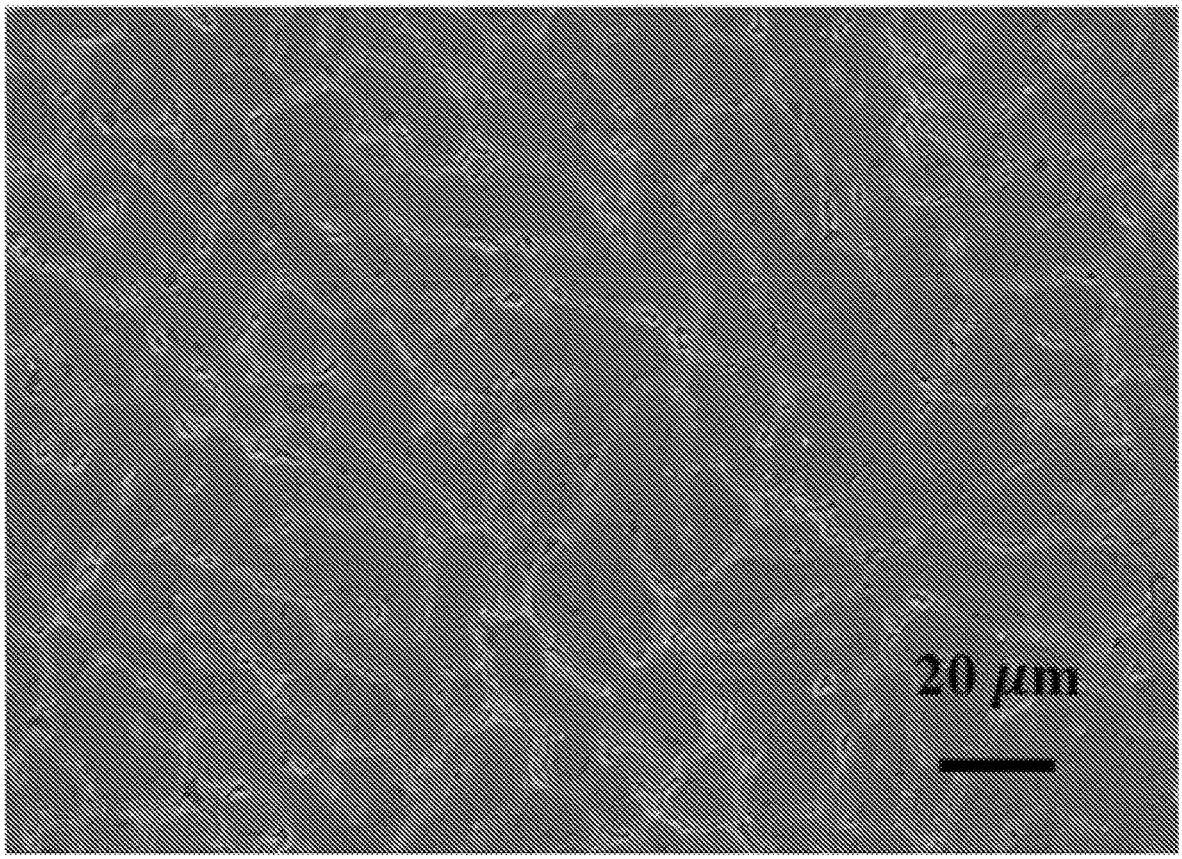
FIG. 2 is a scanning electron microscope (SEM) photograph of the high-strength high-modulus aluminum-based light medium-entropy alloy $Al_xLi_yMg_zZn_uCu_v$ in an embodiment of the present invention.
Figure 3:
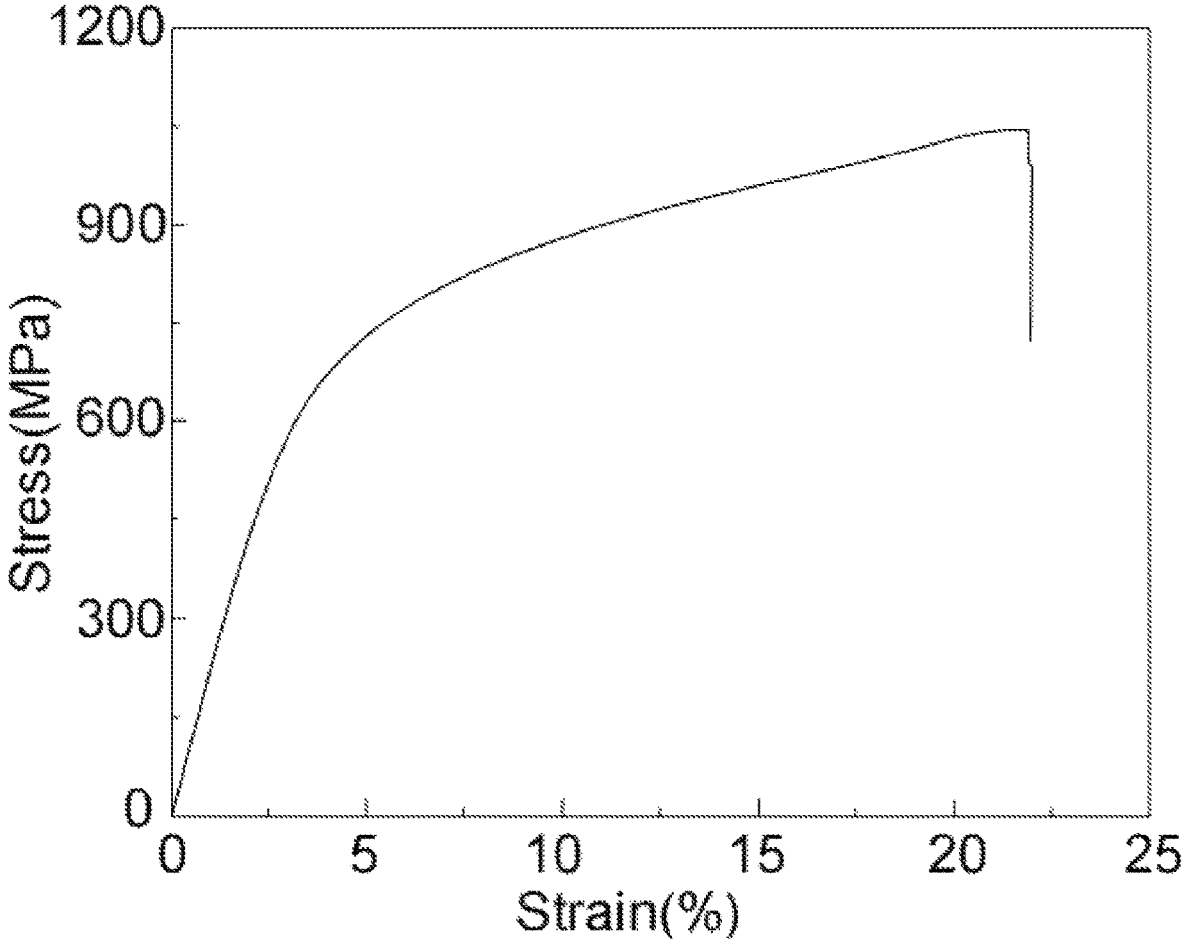
FIG. 3 is compression stress-strain curve chart of the high-strength high-modulus aluminum-based light medium-entropy alloy $Al_xLi_yMg_zZn_uCu_v$ in an embodiment of the present invention.

The molecular formula of a high-strength aluminum-based light medium-entropy alloy in the embodiment is $Al_{80}Zn_{14}Li_2Mg_2Cu_2$, and the preparation process includes the following steps: prepare 100 g of $Al_{80}Zn_{14}Li_2Mg_2Cu_2$ from raw materials, such as Al, Zn, Cu and Mg-20 wt % Li binary master alloy, with the purities of greater than 99.9%; put the proportioned raw materials in a graphite crucible sequentially according to the sequence of melting points from high to low, put an element with the highest melting point at the lowest position, and put an element with the lowest melting point at the highest position; put the graphite crucible loaded with the alloy materials in a spiral induction coil, vacuumize to 20 Pa and below, and then introduce argon to 0.3 MPa; start a high-frequency induction device, gradually increase heating current when the heating current is within the range of 100 A to 200 A, and after an alloy ingot is molten completely, maintain the molten condition of the alloy for 15 min so that the alloy composition is uniform; and cast a uniformly molten alloy solution in a stainless steel mold in a diameter of 75 mm. The embodiment provides a high-strength aluminum-based light medium-entropy alloy, the compressive strength of the alloy exceeds 1 GPa, and the fracture plasticity reaches 22%.

Embodiment 2

The molecular formula of the high-strength aluminum-based light medium-entropy alloy in the embodiment is $Al_{83}Zn_{11}Li_2Mg_2Cu_2$, and the preparation process includes the following steps: prepare 100 g of $Al_{83}Zn_{11}Li_2Mg_2Cu_2$ from raw materials, such as Al, Zn, Cu and Mg-20 wt % Li binary master alloy, with the purities of greater than 99.9%; put the proportioned raw materials in the graphite crucible sequentially according to the sequence of melting points from high to low, put an element with the highest melting point at the lowest position, and put an element with the lowest melting point at the highest position; put the graphite crucible loaded with the alloy materials in a spiral induction coil, vacuumize to 20 Pa and below, and then introduce argon to 0.3 MPa; start a high-frequency induction device, gradually increase heating current when the heating current is within the range of 100 A to 200 A, and after an alloy ingot is molten completely, maintain the molten condition of the alloy for 15 min so that the alloy composition is uniform; and cast the uniformly molten alloy solution in the stainless steel mold in a diameter of 75 mm. The compressive strength of the aluminum-based light medium-entropy alloy obtained in the embodiment reaches 904 MPa.

Embodiment 3

The molecular formula of the high-strength aluminum-based light medium-entropy alloy in the embodiment is $Al_{77}Zn_{17}Li_2Mg_2Cu_2$, and the preparation process includes the following steps: prepare 100 g of $Al_{77}Zn_{17}Li_2Mg_2Cu_2$ from raw materials, such as Al, Zn, Cu and Mg-20 wt % Li binary master alloy, with the purities of greater than 99.9%; put the proportioned raw materials in the graphite crucible sequentially according to the sequence of melting points from high to low, put an element with the highest melting point at the lowest position, and put an element with the lowest melting point at the highest position; put the graphite crucible loaded with the alloy materials in a spiral induction coil, vacuumize to 20 Pa and below, and then introduce argon to 0.3 MPa; start a high-frequency induction device, gradually increase heating current when the heating current is within the range of 100 A to 200 A, and after an alloy ingot is molten completely, maintain the molten condition of the alloy for 15 min so that the alloy composition is uniform; and cast the uniformly molten alloy solution in the stainless steel mold in a diameter of 75 mm. The compressive strength of the aluminum-based light medium-entropy alloy obtained in the embodiment reaches 926 MPa.

Above all, the method of the present invention is simple and practicable. The above embodiments only illustrate the technical conceptions and characteristics of the present invention, and aim to enable persons to get familiar with the technology to understand the content of the present invention and perform the implementation, but not to limit the protective scope of the present invention. All equivalent amendments or modifications for the spiritual natures of the present invention should be contained in the protective scope of the present invention.

What is claimed is:

1. An aluminum-based alloy, wherein the molecular formula of the alloy is $Al_xLi_yMg_zZn_uCu_v$, subscripts representing the atomic molar percentage of each corresponding alloy element; wherein Al 79.3%-80.7%;

Li 1.3%-2.7%;

Mg 1.3%-2.7%;

Zn 13.3%-14.7%;

Cu 1.3%-2.7%.

2. A preparation method of the aluminum-based alloy according to claim 1, wherein the preparation process comprises the following steps:

step 1, proportioning Al, Zn, Cu and Mg-20 wt % Li binary master alloy in alloy ingredients according to the atomic molar percentages;

removing oxide layers on the surface of each raw material by using a grinding machine before proportioning, and then weighing the raw materials by using an electronic balance, wherein the purity of each raw material is greater than 99.9%;

step 2, putting the proportioned raw materials in a graphite crucible sequentially according to the sequence of melting points from high to low, putting an element with the highest melting point at the lowest position, and putting an element with the lowest melting point at the highest position;

step 3, putting the graphite crucible loaded with the alloy materials in a spiral induction coil, vacuumizing to 20 Pa and below by using a mechanical pump, and then introducing argon to 0.3 MPa;

step 4, starting a high-frequency induction device, gradually increasing induction heating current when the current is within the range of 100 A to 200 A, and after an alloy ingot is molten completely, maintaining the molten condition of the alloy and preserving the temperature for 13 to 17 min so that each alloy element is diffused uniformly; and step 5, turning off an induction power supply, casting an alloy melt in a stainless steel mold in a diameter of 75 mm so as to obtain an alloy ingot.

3. The preparation method of the aluminum-based alloy according to claim 2, wherein the temperature when the alloy is molten in step 4 is controlled between 700° C. to 1000° C.

* * * * *